US005186553A

United States Patent [19]

Sugiura et al.

[11] Patent Number: 5,186,553

[45] Date of Patent: Feb. 16, 1993

[54] PRINTER AND METHOD

[75] Inventors: Ikuzo Sugiura, Sagamihara; Mitsuo Uchimura, Numazu; Kouichi Kawamura, Mishima, all of Japan; Ronald L. Fogle, Lebanon; Orville C. Huggins, Dayton, both of Ohio

[73] Assignee: Monarch Marking Systems, Inc., Dayton, Ohio

[21] Appl. No.: 703,089

[22] Filed: May 20, 1991

Related U.S. Application Data

[62] Division of Ser. No. 223,207, Aug. 15, 1988, Pat. No. 5,051,009, which is a division of Ser. No. 885,886, Jul. 15, 1986, Pat. No. 4,776,714.

[51] Int. Cl.[5] ..... B65H 75/00

[52] U.S. Cl. ..... 400/242; 400/248; 400/250; 400/208; 242/197; 242/199

[58] Field of Search ..... 400/250, 194, 196, 207, 400/208, 208.1, 240.3, 240.4, 242, 246, 247, 248, 248.1, 250, 120, 224.2; 242/197, 199, 198

[56] References Cited

U.S. PATENT DOCUMENTS

| | | | |
|---|---|---|---|
| 967,706 | 8/1910 | Barney | 400/242 |
| 2,667,257 | 1/1954 | Hurtado | 400/242 |
| 3,022,879 | 2/1962 | Heidt et al. | 400/250 |
| 3,977,511 | 8/1976 | Hengezhaupt | 400/207 |
| 4,492,159 | 1/1985 | Clark | 400/234 |
| 4,531,690 | 7/1985 | Condy | 400/208 |
| 4,611,218 | 9/1986 | Watanabe | 400/208 |
| 4,614,289 | 9/1986 | Ruyten | 242/198 |
| 4,673,304 | 6/1987 | Liu et al. | 400/240.4 |
| 4,687,358 | 8/1987 | Saitou | 400/208 |
| 4,736,904 | 4/1988 | Schoettle et al. | 242/199 |
| 4,776,714 | 10/1988 | Sugiura et al. | 400/208 |
| 4,919,555 | 4/1990 | Kikuchi | 400/242 |
| 4,944,619 | 7/1990 | Suzuki et al. | 400/224.2 |
| 4,997,298 | 5/1991 | Uchimura et al. | 400/248.1 |

FOREIGN PATENT DOCUMENTS

| | | | |
|---|---|---|---|
| 9443 | 1/1977 | Japan | 400/120 |
| 106888 | 8/1981 | Japan | 400/120 |
| 1776 | 1/1982 | Japan . | |
| 199677 | 12/1982 | Japan . | |
| 36479 | 3/1983 | Japan . | |
| 0070597 | 4/1984 | Japan | 400/208 |
| 0021288 | 2/1985 | Japan | 400/246 |
| 85981 | 5/1985 | Japan | 400/120 |
| 90792 | 5/1985 | Japan | 400/120 |
| 155485 | 8/1985 | Japan | 400/120 |
| 0178077 | 9/1985 | Japan | 400/636 |
| 210479 | 10/1985 | Japan | 400/120 |
| 0236780 | 11/1985 | Japan | 400/208 |
| 245574 | 12/1985 | Japan | 400/208 |
| 250981 | 12/1985 | Japan . | |
| 0016878 | 1/1986 | Japan | 400/248 |
| 31270 | 2/1986 | Japan | 400/208 |
| 51371 | 3/1986 | Japan | 400/120 |
| 66661 | 4/1986 | Japan | 400/120 |
| 68276 | 4/1986 | Japan | 400/208 |
| 78681 | 4/1986 | Japan | 400/120 |
| 121979 | 6/1986 | Japan | 400/208 |
| 139470 | 6/1986 | Japan | 400/208 |
| 1176097 | 10/1968 | United Kingdom | 400/248 |
| 1455915 | 11/1976 | United Kingdom | 400/208 |
| 2162794 | 2/1986 | United Kingdom | 400/208 |

*Primary Examiner*—Eugene H. Eickholt
*Attorney, Agent, or Firm*—Joseph J. Grass

[57] ABSTRACT

There is disclosed a printer having a thermal print head and a cooperable platen roll. The platen roll is driven to advance a web of record medium and an ink ribbon into cooperation with the print head. The printer can use an ink ribbon cartridge. The printer has a compact arrangement for the record medium supply roll, the ink ribbon cartridge, the printing mechanism, the drive mechanism, the keyboard, and the cutting mechanism for cutting tags from the web.

17 Claims, 9 Drawing Sheets

FIG-1
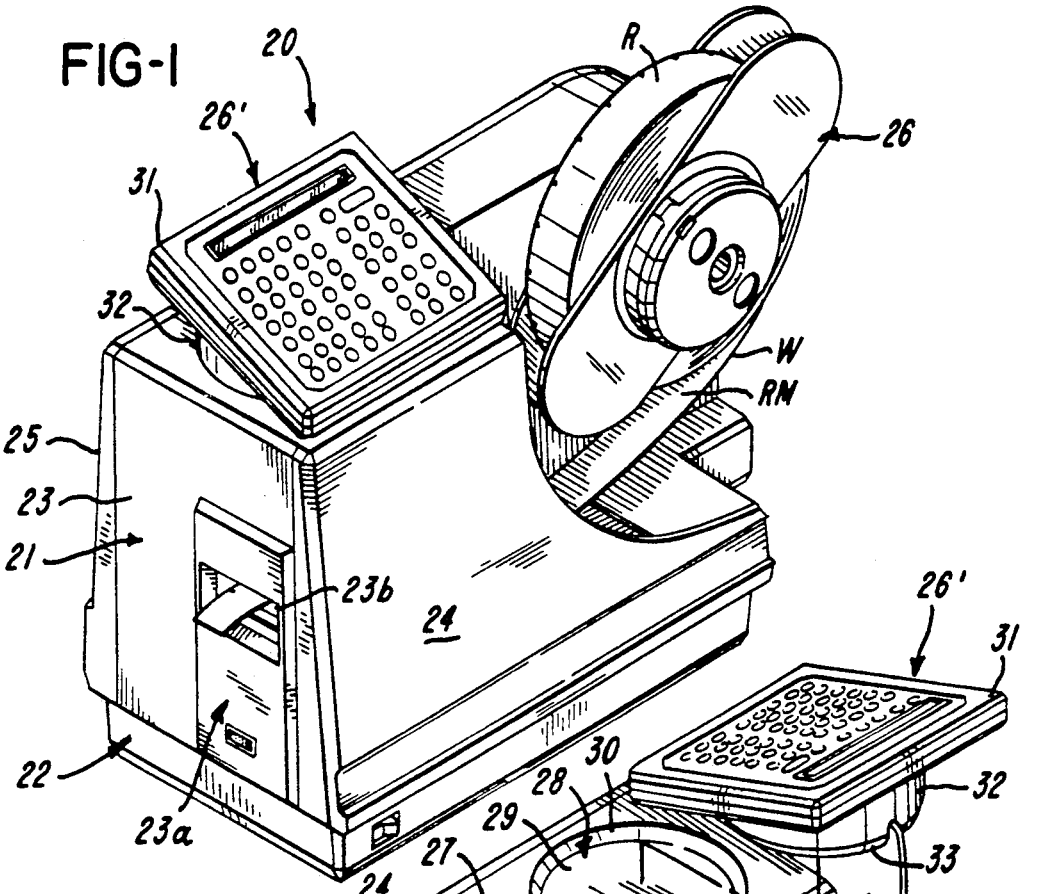
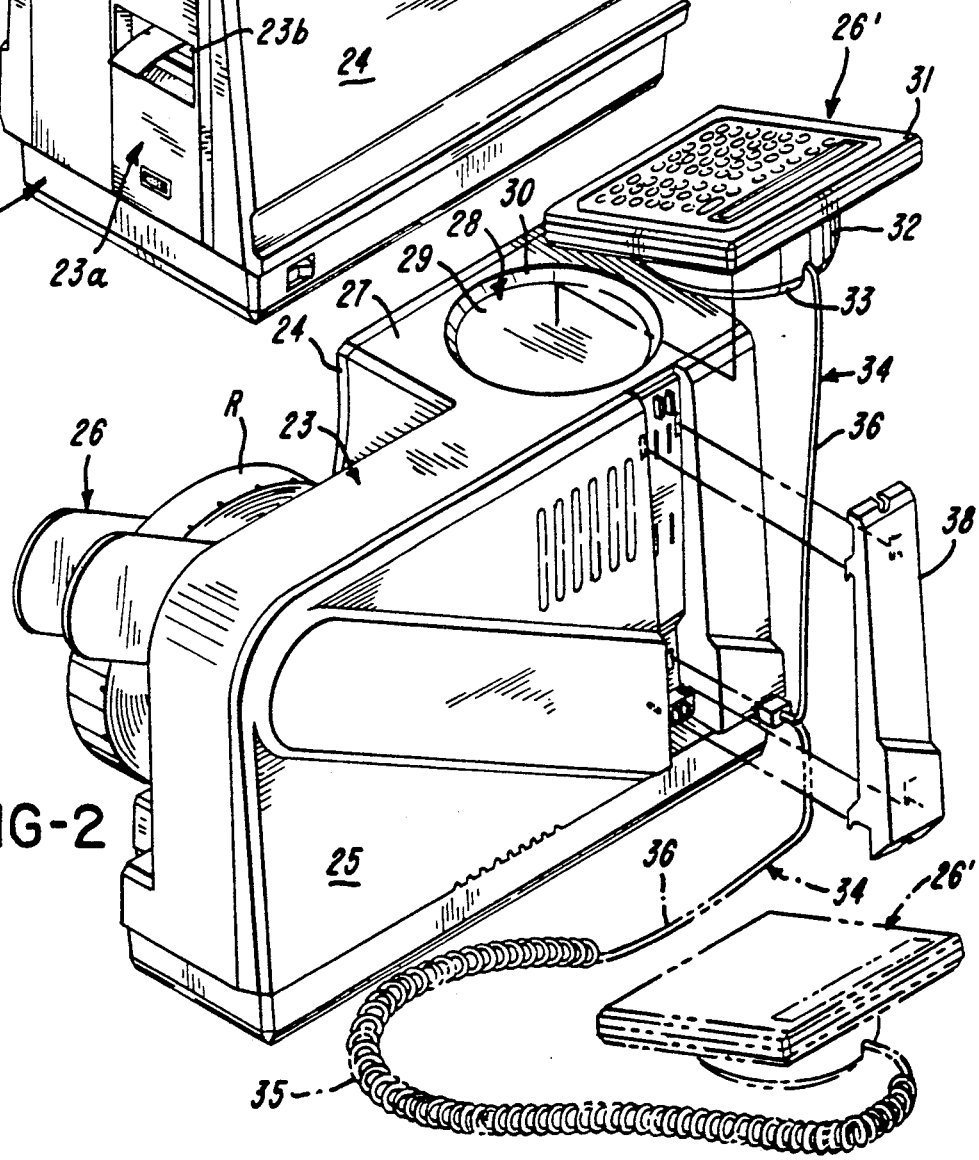
FIG-2

44
94
89
218
90
91
147
93
147
217
95
100
99
215
97
145
92
104
146
105
107
103
96
215a
214
101
98
106
102
146a
147
147a
120
122
114
115
116
112
113
114
139
136
124
113
137
117
118
140
140
125
119
117
110
142
123
125
111
143
121
141
135
108'
138
111
133
110
126
138
141
108
CL
109
134
131
132
129
128
130
127

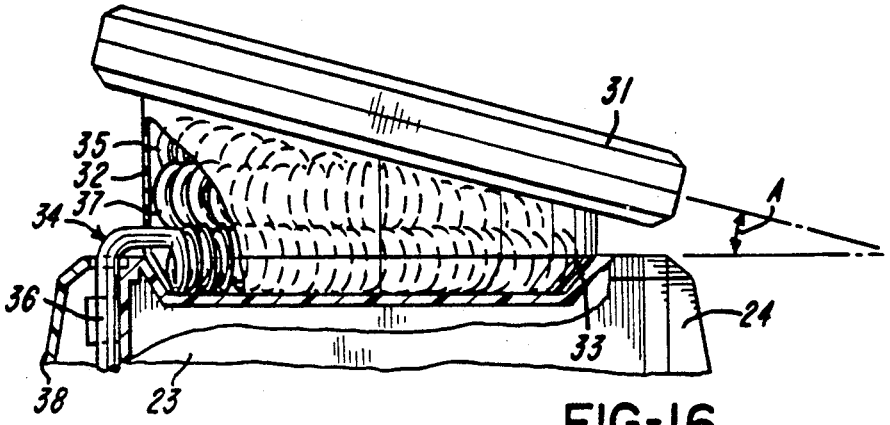
FIG-16
FIG-15
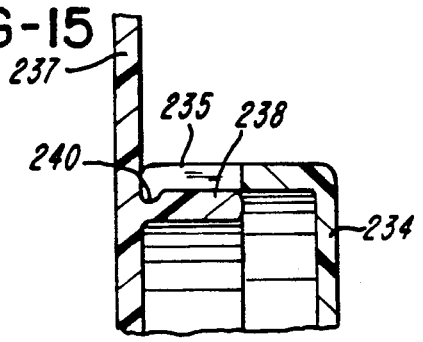
FIG-17
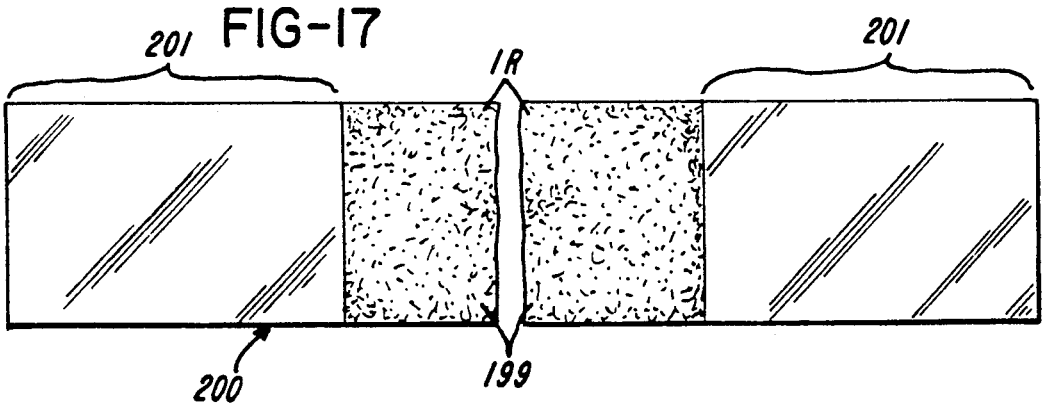

PRINTER AND METHOD

CROSS-REFERENCE TO RELATED APPLICATION

This is a division of application Ser. No. 223,207, filed Aug. 15, 1988, now U.S. Pat. No. 5,051,009; which is a division of application Ser. No. 885,886, filed Jul. 15, 1986, now U.S. Pat. No. 4,776,714, which issued Oct. 11, 1988.

BACKGROUND OF THE INVENTION

1. Field of the Invention

This invention relates to the field of printers and ink ribbon cartridges and method of using ink ribbon cartridges.

2. Brief Description of the Prior Art

The following U.S. Pat. Nos. are made of record: 2,755,905; 3,767,098; 4,160,605; 3,877,561; 3,830,351; 4,476,510; 4,350,452; 4,122,985; 4,473,426; and 4,568,950.

SUMMARY OF THE INVENTION

It is a feature of the invention to provide an improved ink ribbon cartridge having one or more floating guides that cause the ink ribbon to track in alignment with a print head. The guide or guides are precisely positioned by means of a pin or pins precisely located on the printer.

It is another feature of the invention to provide a method of installing an ink ribbon cartridge in a printer. According to the method, the portion of the ink ribbon which is exposed outside the housing of the cartridge is caused to be trained along a non-linear path which generally duplicates or matches the printer path through which the ink ribbon passes when the cartridge is positioned in the printer. When the cartridge is loaded into the printer the exposed ink ribbon portion passes between the print head and platen roll and partly about a guide. An installation device is conveniently used to practice the method.

The printer of the invention includes an improved drive mechanism for a platen roll and the cartridge to effect advance of both the record medium and the ink ribbon. A single motor is used in the drive mechanism. A take-up roll for the ink ribbon is continuously driven through a slip-clutch.

The printer of the invention includes an arrangement of guides for handling webs of record medium which are wound either face-side-in or face-side-out.

The invention also includes an improved reel assembly which can mount either large or small diameter rolls of record medium. For small diameter rolls, a hub passes through and supports the roll. For large diameter rolls, the hub mounts hub members which in turn mount the roll.

The invention also relates to a keyboard removably nested on the printer. The keyboard is rotatable relative to the printer or if desired the keyboard can be placed on a horizontal surface adjacent the printer while the keyboard and the printer are connected via a data cord. The keyboard has a base portion with a stuffing chamber wherein a portion of the data cord can be stored while the keyboard is nested on the printer. When the keyboard is placed on the horizontal surface adjacent the printer the data cord is removed from the stuffing chamber to enable the keyboard to be placed at a distance from the printer.

Other features and advantages will readily suggest themselves to the art-skilled person upon reference to the accompanying drawings and the following detailed description.

BRIEF DESCRIPTION OF THE DRAWINGS

FIG. 1 is a perspective view of a printer in accordance with the invention;

FIG. 2 is a perspective view of the printer shown in FIG. 1, but depicting the rear side thereof;

FIG. 15 is a fragmentary sectional view showing one hub member stored on the other hub member;

FIG. 16 is a partly sectional elevated view of the keyboard mounted on the printer housing; and FIG. 17 is a fragmentary top plan view of an ink ribbon used in the cartridge.

DETAILED DESCRIPTION OF THE PREFERRED EMBODIMENT

Figure 3:
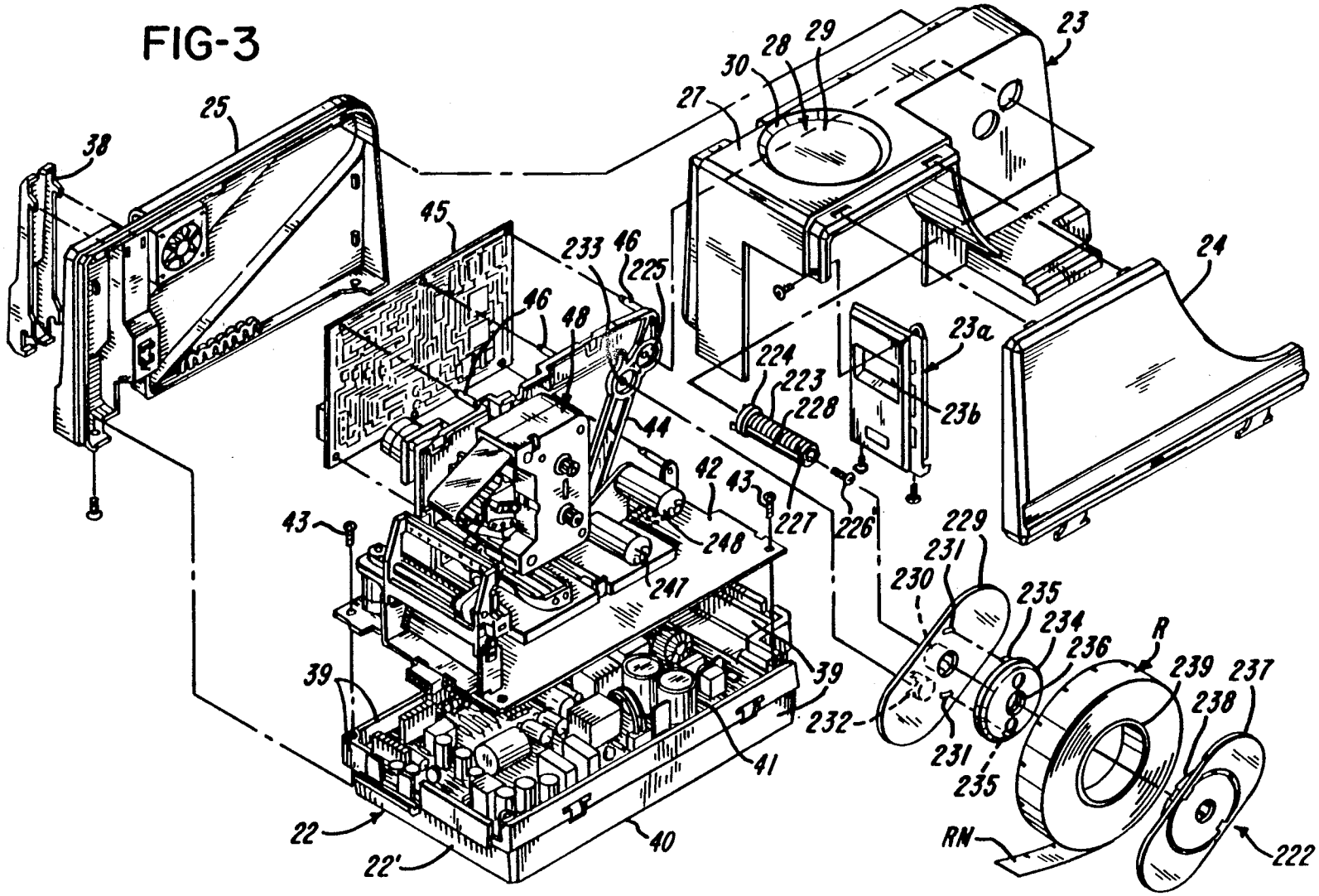
FIG. 3 is a partially exploded perspective view of the printer showing its housing and certain operative components.

With reference to FIG. 1, there is shown a printer generally indicated at 20. The printer 20 includes an upper housing portion or printer body generally indicated at 21 and a lower housing portion generally indicated at 22. The upper housing portion 21 includes a main housing section 23, a front housing section 24 and a rear housing section 25. The housing section 23 includes a separate panel **23*a* having an opening 23*b*. A reel assembly generally indicated at 26 mounts a roll R of a web W of record members RM. The web W can be comprised either of a tag material as shown, or of pressure sensitive labels releasably adhered to a carrier web. A keyboard generally indicated at 26' is mounted on the housing section 23. As shown in FIG. 2, upper surface 27 of the main housing section 23 has a recess 28 comprised of a flat horizontal surface 29 and an inwardly and downwardly sloping frustro-conical wall 30 joining the surfaces 27 and 29. The keyboard 26' has a keyboard portion 31** inclined at an angle A of about 15° with respect to the horizontal (FIG. 16). Joined to the keyboard portion 31 is a base portion 32. The lower portion of the base portion 32 is frusto-conical as indicated at 33. The base portion 32 thus rotatably nests in the recess 28 as shown in FIGS. 1 and 16. Thus, the keyboard 26' can be rotated to a position convenient to the user. There is a data cord 34 which connects the keyboard 26' and the printer 20. The data cord 34 includes a coiled flexible portion 35 and a straight but flexible portion 36. The base 32 is hollow to provide a stuffing chamber 37 (FIG. 16) so at least a portion of the data cord 34, preferably the entire coiled portion 35, can be stuffed into the stuffing chamber 37. FIG. 2 shows the keyboard 26' removed form the printer 20 and thereupon the keyboard 26' can be placed in any convenient position on any flat horizontal surface for operation by the user as shown by phantom lines in FIG. 2. When the keyboard 26' is in its operative position as shown in FIG. 1, the cord portion 36 is held captive between the rear housing section 25 and a removable cover plate 38.

With reference to FIG. 3, the lower housing portion 22 is shown to include a generally open-top box-shaped bottom section 22' having four side walls 39 and a bottom wall 40. The bottom section 22' receives a horizontally disposed printed circuit board 41. A generally horizontal base or frame plate 42 is secured to the bottom section 22' by screws 43. The printed circuit board 41 containing the power supply is thus located in the space between walls 39, above bottom wall 40 and below the base plate 42. A vertical frame plate 44 or case is screwed to the base plate 42 in a generally T-shaped arrangement. A generally vertical printed circuit board 45 is mounted on posts 46 in spaced apart relationship to one side of the frame plate 44. The base plate 42 is preferably constructed of metal or at least includes enough metal to shield the printed circuit board 45 from radiation from the circuit board 41.

Figure 4:
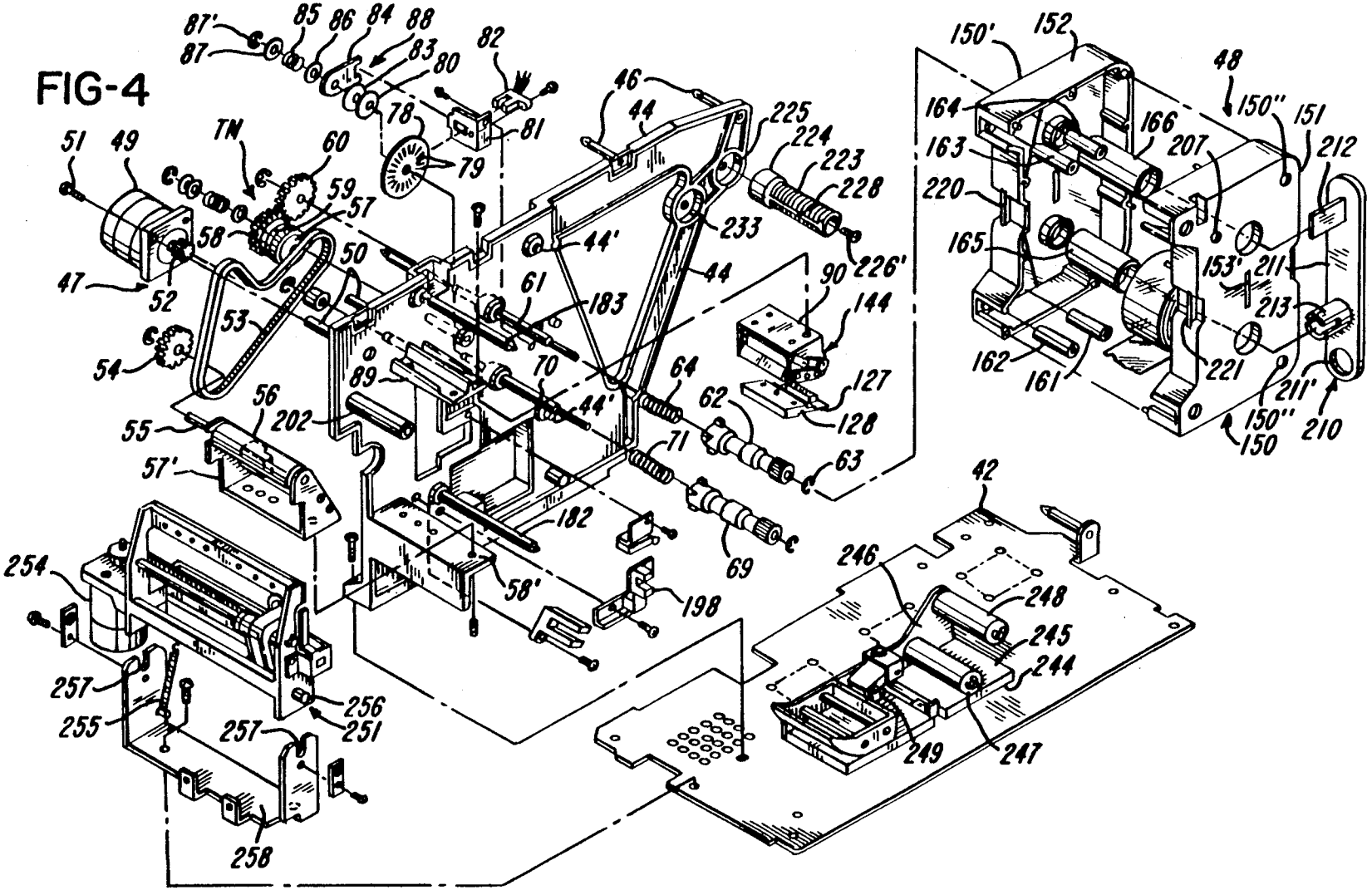
FIG. 4 is a partially exploded perspective view of various components of the printer and the ink ribbon cartridge.
Figure 9:
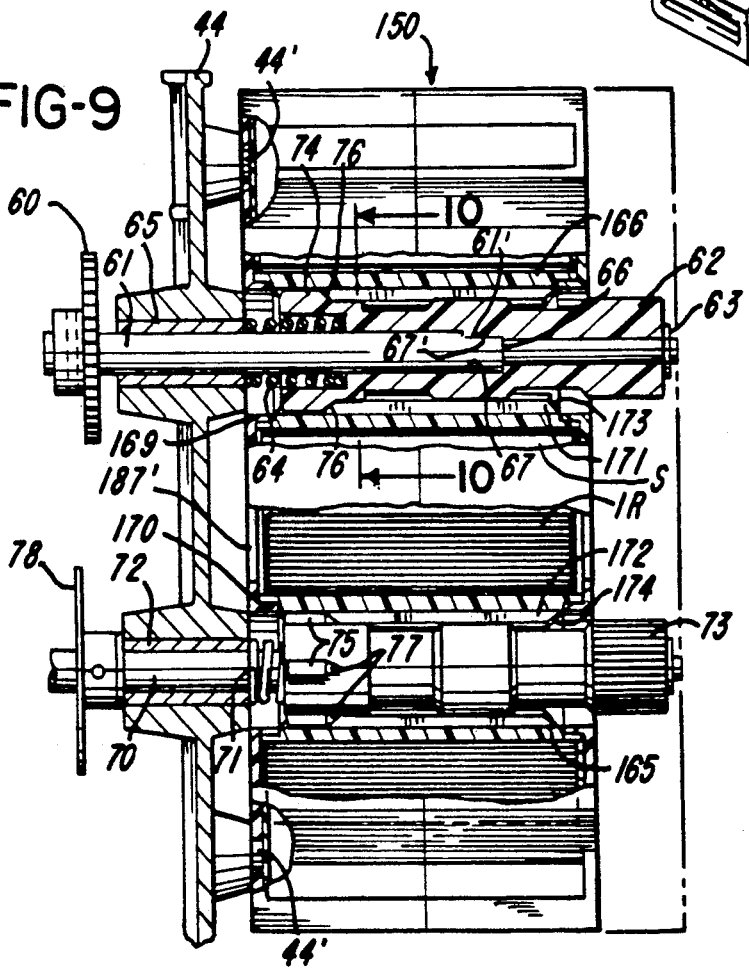
FIG. 9 is a sectional view taken along line 9—9 of FIG. 5.
Figure 10:
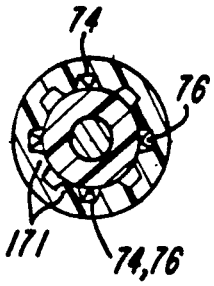
FIG. 10 is a sectional view taken along line 10—10 of FIG. 9.

A drive mechanism generally indicated at 47 in FIG. 4 is disposed in a plane between the frame plate 44 and the printed circuit board 45. Various operative components of the printer 20 to be described in detail hereinbelow and an ink ribbon cartridge generally indicated at 48 are disposed on the other side of the frame plate 44. The drive mechanism 47 includes an electric motor 49 mounted to posts 50 on the frame plate 44 by screws 51 (only one of which is shown). The motor 49 directly drives a pinion 52 which in turn drives a flexible endless toothed belt 53. The belt 53 drives a toothed wheel 54 secured to a shaft 55 of a platen in the form of a platen roll 56. The shaft 55 is rotatably journaled in a bracket 57' secured to a support 58' rigidly cantilevered to the frame plate 44. When the motor 49 drives the toothed wheel 52, the belt 53 advances and rotates the toothed wheel 54 and in turn the shaft 55 and the platen roll 56. Advance of the belt 53 also causes rotation of a toothed wheel 57. The toothed wheel 57 drives a gear 58 through a slip-clutch 59. The gear 58 meshes with a gear 60 secured to a shaft 61. A spindle or ribbon feed shaft 62 is suitably keyed against rotation to the shaft 61. With reference to FIG. 9, an E-ring 63 is secured to the shaft 61. A light compression spring 64 encircles the shaft 61 and bears against a bearing 65 in the frame plate 44 and against the spindle 62. The compression spring 64 urges the spindle 62 outwardly away from the frame plate 44. The shaft 61 has a step 66 and the axial hole 67 is also correspondingly stepped. The spindle 62 is captive between the step 66 and the E-ring 63, and relative axial movement of the spindle 62 and the shaft 61 is thus prevented. The shaft 61 has a flat 61' and the hole 67 has a corresponding flat 67' which cooperate to prevent relative rotation between the shaft 61 and the spindle 62. As is evident from FIG. 9, the shaft 61 and the spindle 62 can be shifted to the left as a unit, thereby compressing the spring 64, the shaft 61 can rotate as well as shift axially in the bearing 65. The purpose for the axial shifting is brought out hereinafter. The outer free end portion of the spindle 69 is knurled as indicated at 73 to facilitate manual rotation of the spindle 62.

A spindle or ribbon take-up shaft 69 and shaft 70 are identical to the spindle 62 and the shaft 61. The spindle 69 is likewise urged to the right (FIG. 9) by a light compression spring 71 and the shaft 70 is rotatable and axially shiftable in a bearing 72. As shown, spindles 62 and 69 have peripherally spaced teeth 74 and 75 with tapered ends 76 and 77. A disc 78 having elements 79 (FIG. 4) capable of being sensed is keyed to the shaft 70. A disc-shaped brake member 80 (FIG. 4) is keyed to the shaft 70. A bracket 81 secured to the frame plate 44 mounts an optical sensor 82 which cooperates with the elements 79 in the disc 78 to sense rotation of the disc 78 and the shaft 70. In the event the sensor 82 does not sense sufficient movement of the disc 78, this will indicate a jam and thus the operation of the printer will be interrupted in response to a signal from the sensor 82. A brake disc 83 composed of a frictional material such as felt is disposed between the disc 80 and a stationary brake plate 84. A compression spring 85 is disposed between washers 86 and 87. The washer 86 bears against the brake plate 84 and the washer 87 bears against an E-ring 87' on the shaft 70. The shaft 61 passes through the member 80, the brake disc 83, the brake plate 84, the washer 86, the spring 85 and the washer 87. The brake member 80, the brake disc 83 and the brake plate 84 comprise a continuous brake generally indicated at 88. The toothed wheel 57, the slip clutch 59 and the gears 58 and 60 are considered part of a take-up mechanism generally indicated at TM.

Figure 6:
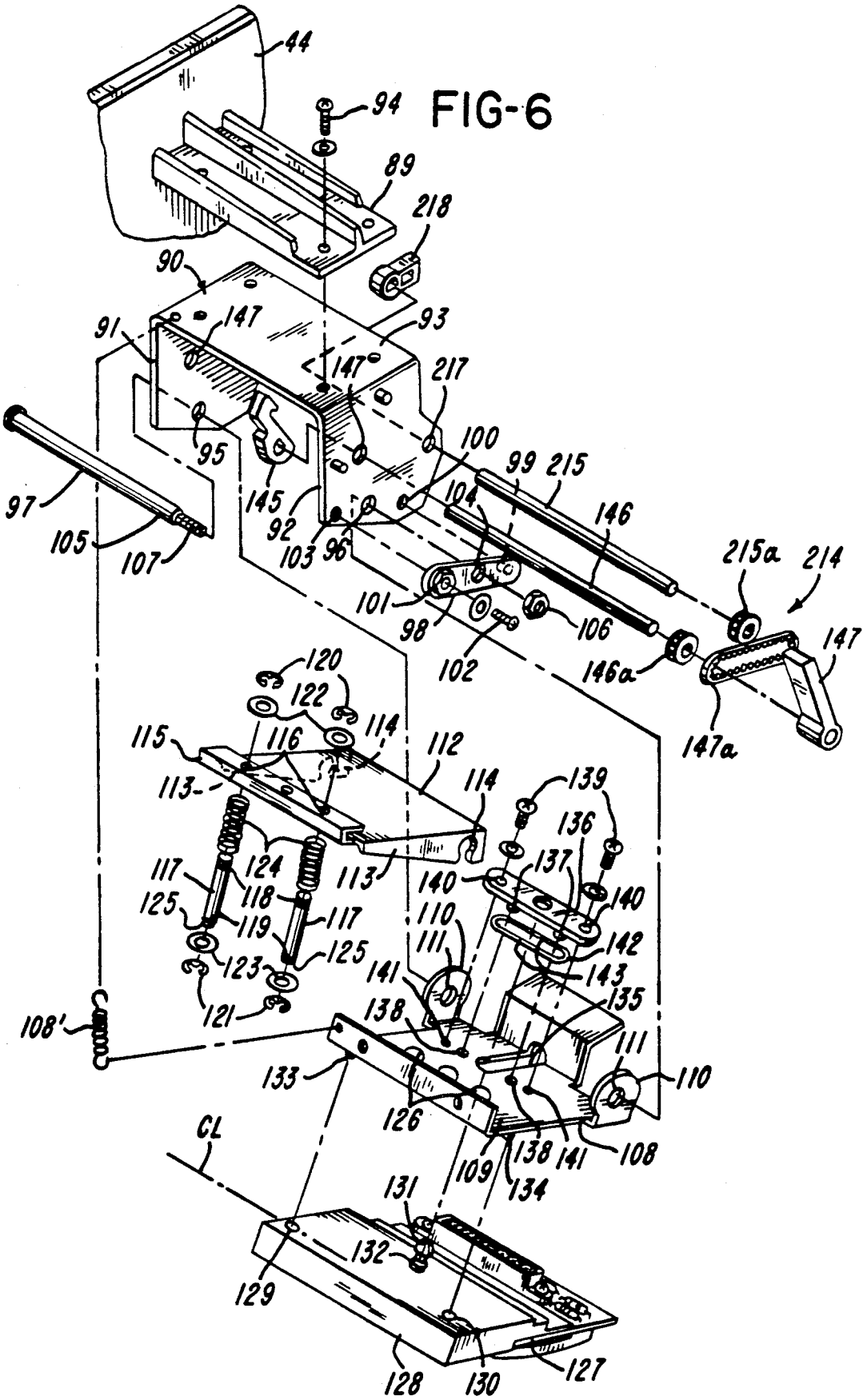
FIG. 6 is an exploded perspective view of the print head and structure for mounting the print head.

A print head support 89 (FIG. 6) is rigidly cantilevered to the frame plate 44. A generally U-shaped bracket 90 has a pair of spaced leg portions 91 and 92 and a connecting bight portion 93. The bight portion 93 is secured to the underside of the support 89 by screws 94, only one of which is shown. The leg portions 91 and 92 have respective holes 95 and 96 for receiving a shaft 97. A plate 98 has a stud 99 received in a hole 100 in the leg portion 92. Spaced from the stud 98 is an oversize hole 101 in the plate 98. A screw 102 passes through the hole 101 and is received in a threaded hole 103. The plate 98 has a hole 104 for receiving end portion 105 of the shaft 97. A nut 106 is received on a threaded portion 107. The hole 96 is oversize so that the angular position or skew of the shaft 97 can be adjusted. This adjustment is accomplished by loosening the screw 102 and pivoting the plate 98 to a new adjusted position and thereupon re-tightening the screw 102.

A print head mounting plate 108 has a generally planar portion 109 having a pair of spaced tabs 110. The tabs 110 have aligned holes 111 for receiving the shaft 97. A cam follower in the form of a pressure plate 112 has a pair of spaced tabs 113 with aligned holes 114 for receiving the shaft 97. The plate 112 has a U-shaped flange 115 having holes 116. Pins 117 are slidably received in and extend through the holes 116. The pins 117 have grooves 118 and 119 for receiving respective E-rings 120 and 121. Washers 122 and 123 are received on the pins 117. Compression springs 124 encircle pins 117 and bear against the flange 115 and the washers 123. Flat ends 125 of the pins 117 bear against convex portions 126 on the planar portion 109 of the plate 108.

A print head 127 is secured to the underside of a print head support plate 128. The plate 128 has a pair of holes 129 and 130 and an upstanding stud 131 having an annular groove 132. A pair of round studs 133 and 134 depend downwardly from the plate 108 and are received in respective holes 129 and 130. The hole 129 is elongated in the direction of the centerline CL, and the hole 130 is round to receive the stud 134. The stud 131 projects through a cutout 135 in the planar portion 109. A plate 136 has a pair of studs 137 received in holes 138 in the planar portion 109. Screws 139 passing through holes 140 in the plate 136 are received in threaded holes 141 in planar portion 109. A flexible resilient endless wire retainer 142 passes about the studs 137. The retainer 142 has generally parallel retainer portions 143 defining a gap. The support plate 128 is attached to the plate 108 by aligning the holes 129 and 131 with the pins 133 and 134 and inserted the tapered head of the stud 131 between the retainer portions 143. The spacing of the retainer portions 143 is less than the width of the stud 131 so that insertion of the stud 31 spreads the portions 143. The portions 143 spring back when the portions 143 are in the groove 132. The retainer 142 thus grips the stud 131 and releasably holds the support plate 128 and the print head 127 which it mounts for easy replacement.

Figure 5:
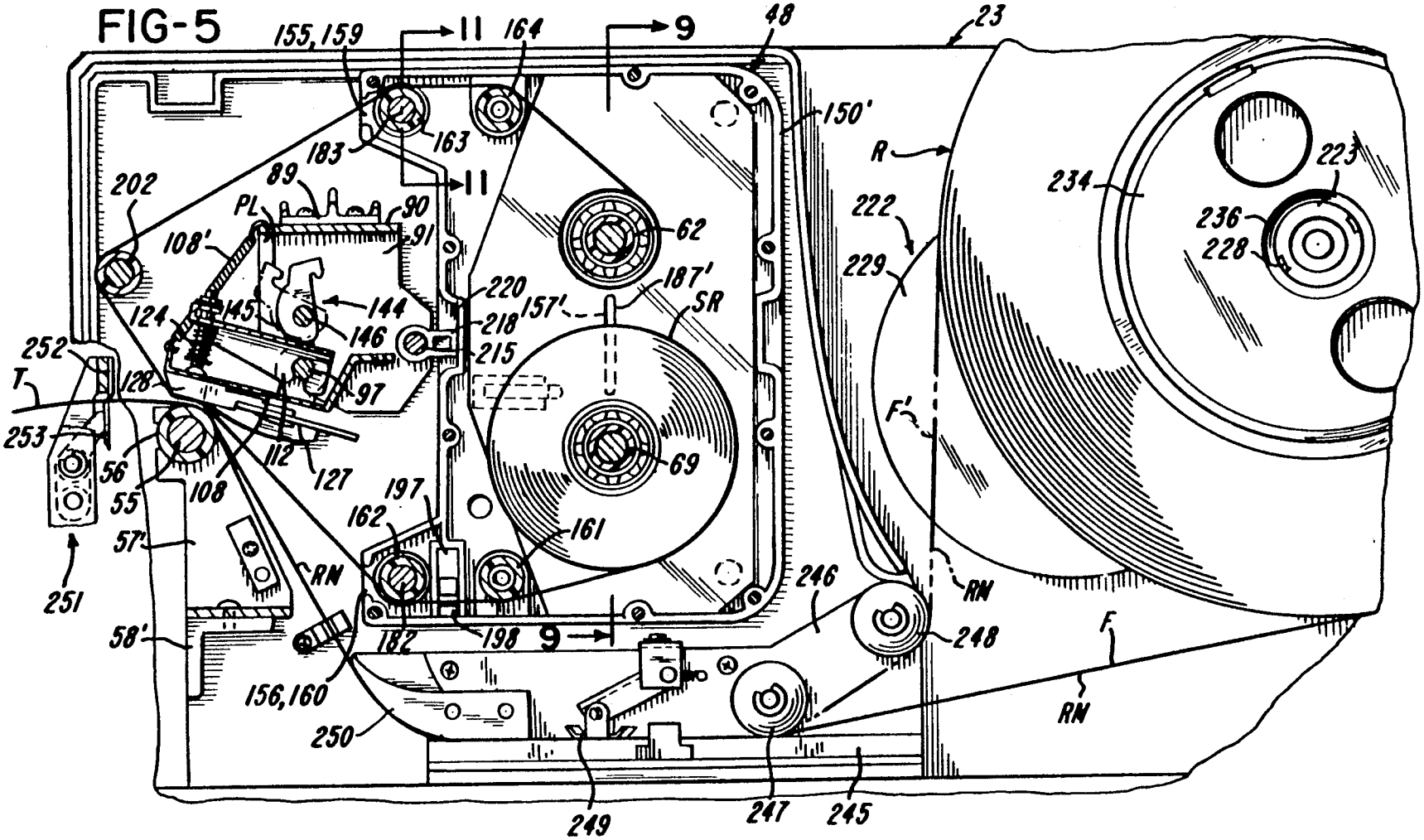
FIG. 5 is a front elevational view of the printer with the front cover removed.

The record medium RM passes partly about the platen roll 56 (FIG. 5). In order to urge the print head 127 against the record medium RM which in turn is urged against the platen roll 56, a manually operable, releasable, printing pressure applying mechanism generally indicated at 144 (FIGS. 5 and 6) is operable to compress the springs 124 and to urge the plates 108 and 128 counterclockwise (FIG. 5) about the shaft 97. The mechanism 144 includes a cam 145 keyed against rotation relative to a shaft 146. A manually operable lever 147 keyed against rotation to the shaft 146 is used to manually pivot the shaft 146 and to move the cam 145 between its operating position shown in solid lines in FIG. 5 to its phantom line position indicated by phantom lines PL. The shaft 146 is journaled in holes 147. The support 128 and the print head 127 which it mounts can be removed from the support 108 when the cam 145 is in its phantom line position. A tension spring 108' pivots the plates 108 and 112 clockwise (FIG. 5) when the cam 145 is in its phantom line position PL to move the print head 127 away from the platen roll 56. This enables the record medium RM and/or the ink ribbon IR to be inserted between or removed from between the print head 127 and the platen roll 56.

Figure 7:
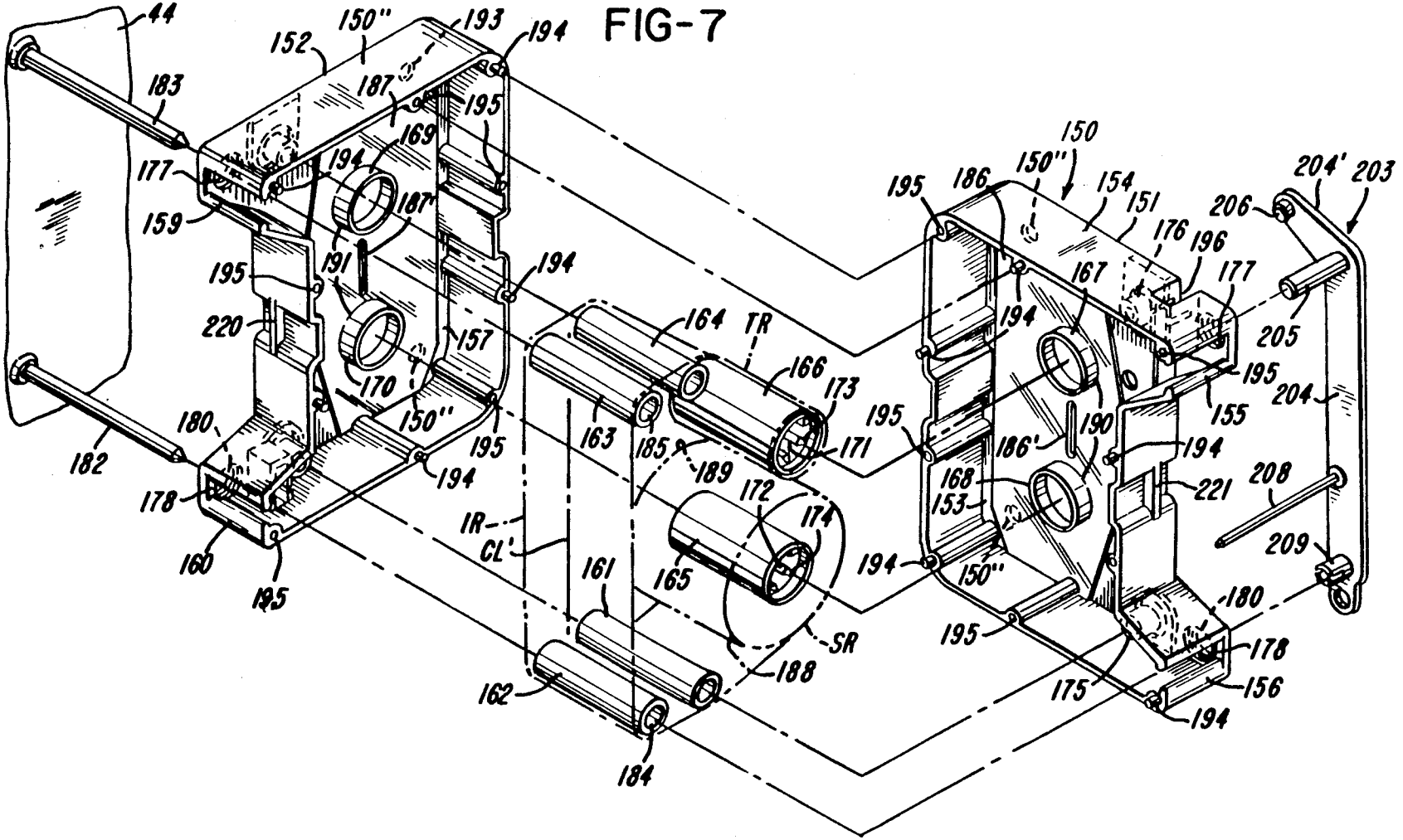
FIG. 7 is an exploded perspective view of the ink ribbon cartridge and a fragmentary portion of the printer, with the cartridge housing sections being rotated to show their interiors.
Figure 8:
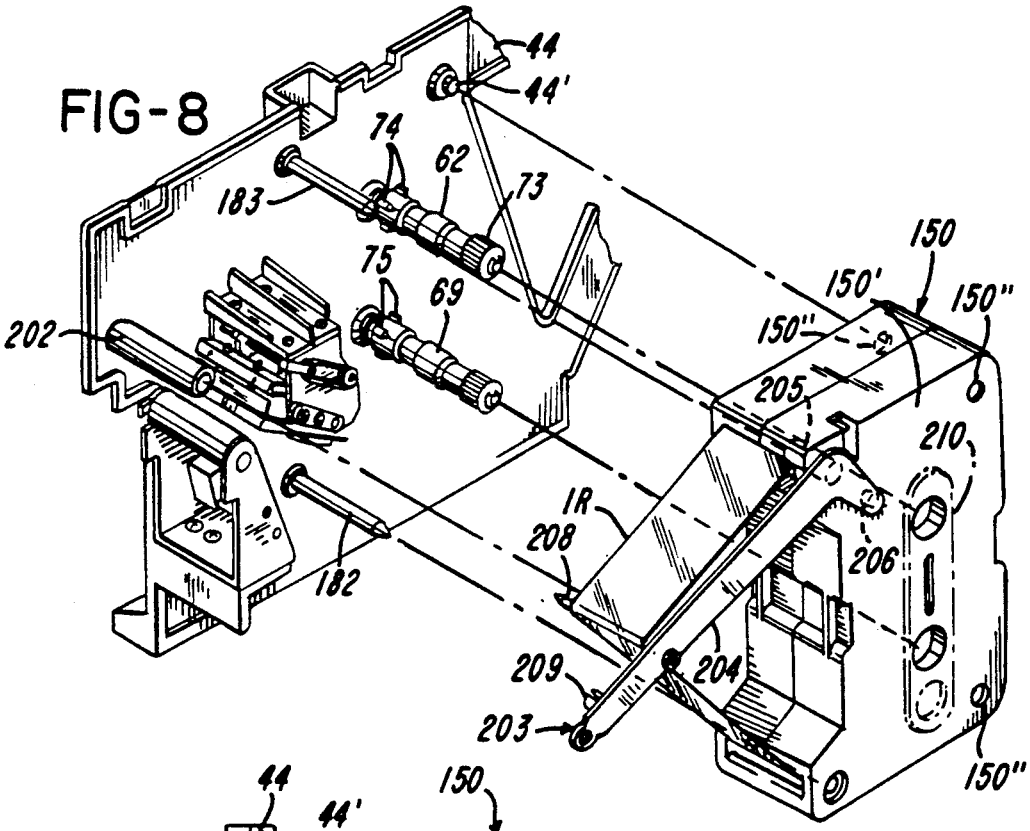
FIG. 8 is a perspective view showing the ink ribbon cartridge ready to be loaded into the printer.

The printer 20 can accept a record medium RM which is either thermally coated paper stock or plain paper stock. A heat-sensitive ink ribbon IR is used with plain paper stock. The printer 20 conveniently uses an ink ribbon cartridge generally indicated at 150 (FIGS. 7, 8 and 9). The cartridge 150 includes a housing 150' and pair of essentially mirror-image ink cartridge housing section 151 and 152 composed of molded plastics material. The cartridge housing 150' defines interior space S. The housing 150' has holes 150'' for receiving locating and mounting pins 44'. The housing section 151 has a generally planar end plate 153 joined to a wall 154 having openings 155 and 156. The housing section 152 has a generally planar end plate 157 joined to a wall 158 having openings 159 and 160. The pair of openings 155 and 159 are aligned, and the pair of openings 156 and 160 are aligned. The ink ribbon IR from a supply roll SR, passes partly about guides or guide rolls 161 and 162, passes through the pair of openings 156 and 160, enters the pair of openings 155 and 159, passes partly about guides or guide rolls, or shaft covers or cylindrical members 163 and 164 and is wound into a take-up roll TR. The guide rolls 161, 162, 163 and 164, which are identical in construction, are tubular. The supply roll SR is wound onto a rotatable spool or roll or core 165 and the take-up roll TR is wound onto a rotatable spool or roll or core 166. The end wall 153 has a pair of spaced tubular mounting members or flanges 167 and 168, and the end wall 157 has a pair of spaced tubular mounting members or flanges 169 and 170. The members 167 and 169 are received in the end portions of the roll 166, and the members 168 and 170 are received in the end portions of the roll 165. The rolls 165 and 166 are tubular and their inside surfaces have angularly spaced teeth 171 and 172. The ends of the teeth 171 and 172 are tapered as indicated at 173 and 174.

Figure 11:
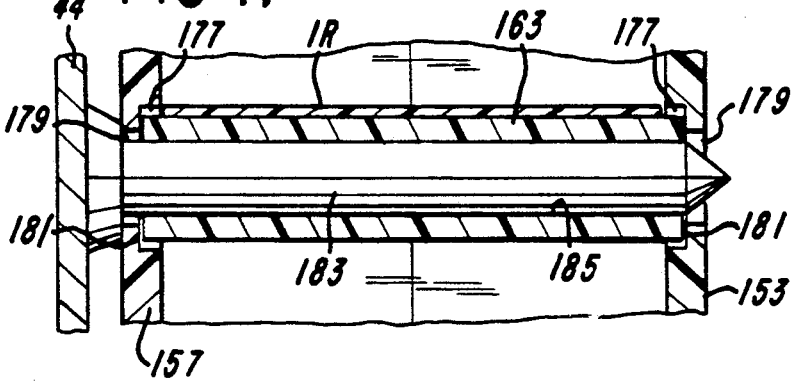
FIG. 11 is a sectional view taken along line 11—11 of FIG. 5 and showing a guide roller of the ink ribbon cartridge aligned by a guide pin of the printer.
Figure 12:
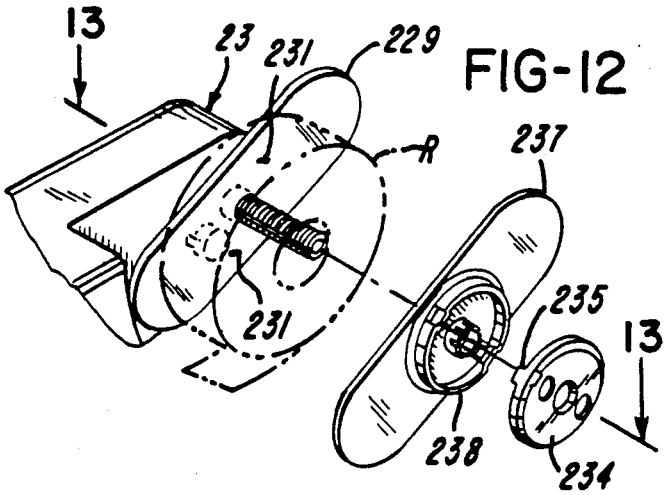
FIG. 12 is an exploded perspective view of a supply roll mounting mechanism.

The rolls 161 and 164 are tubular and are rotatably mounted on pairs of aligned tubular studs 175 and 176. The rolls 163 and 162 are loosely or floatingly retained in oversize pairs of recesses 177 and 178, as best shown in FIG. 11. The pair of recesses 177 and the pair of recesses 178 open into respective holes 179 and 180. FIG. 11 shows the recesses 177 and holes 179 in detail, it being understood that recesses 178 and the holes 180 have the same construction. As shown, each recess 177 and its associated hole 179 are provided by a stepped diameter. Also shown in FIG. 11 is that the roll 163 is shorter than the distance between surfaces 181 of the end walls 153 and 157. The frame member 44 has a pair of precisely located parallel locator or mounting pins or guide shafts 182 and 183 (FIG. 7). The front ends of the pins 182 and 183 are shown to be cone shaped. The pins 182 and 183 are received in the bores 184 and 185 of the respective tubular rolls 162 and 163. Like the roll 202, as shown, the rolls 161, 162, 163 and 164, the spindles 62 and 69 and the pins 182 and 183 extend in a cantilevered state from the frame plate 44. The fit between the outside of the pins 182 and 183 is preferably such that the rolls 162 and 163 can rotate but with clearance being at a minimum. The pins 182 and 183 and not the cartridge housing 150' determine the positioning of the rolls 162 and 163. In that the rolls 162 and 163 are maintained parallel to each other by the pins 182 and 183, the ink ribbon IR can track in correct alignment against the record medium RM between the print head 127 and the platen roll 56. It is to be noted that the housing 150' can even be misaligned or skewed relative to the rolls 162 and 163 because the tracking of the ink ribbon IR is controlled by the rolls 162 and 163.

Sheets 186 and 187 of electrically conductive material are positioned along the respective end walls 153 and 157. Ends 188 and 189 of the ink ribbon IR contact the sheets 186 and 187. The sheets 186 and 187 have respective holes 190 and 191 for snugly receiving mounting members 167 and 168, and 169 and 170. Each wall 153 and 157 has a respective hole 150''. The pins 44' (FIGS. 4 and 9) enter the holes 150'' irrespective of the orientation of the cartridge 150 to ground the sheet 186 or 187 which is lightly in contact with the ink ribbon IR. Thus, static electricity is continuously drained from the ink ribbon IR.

The housing sections 151 and 152 are aligned and held together by pins 194 fitting snugly into recesses 195. The housing sections are shown to have openings 196 and 197. Depending on the positioning of the cartridge 150 in the printer 20, either the openings 196 or the opening 197 is positioned to receive an optical sensor 198 which forms a part of the printer 20. In the illustrated embodiment, the ink ribbon IR is drawn off the supply roll SR and passes partly about the rolls 161 and 162. As shown the ink ribbon IR passes through the sensor 198 as it passes from the roll 161 to the roll 162. The sensor 198 is mounted on the frame plate 44 and projects into the opening 197 when the cartridge 150 is in place in the printer 20. As shown in FIG. 17, the ink ribbon IR has a coating 199 of heat-activatable colorant throughout most of its length provided on an transparent or at least translucent film 200. However, the end portions 201 of the film 200 are free of the coating 199 and thus light is capable of being transmitted through the film 200 and detected by the sensor 198. Thus, when the ink ribbon IR is nearly exhausted from the supply roll SR, the power to the printer 20 is interrupted.

Each end plate 153 and 154 and its respective sheet 186 and 187 of electrically conductive material is provided with a respective slot 153' and 154', and 186' and 187' so that the user can visually observe how much of the ink ribbon IR has been spent. The slots 153' and 186' are aligned, and the slots 157' and 187' are aligned.

In that the spindles 62 and 69 are spring-urged by respective springs 64 and 71, the cartridge 150 can be loaded fully into the printer 20 with studs 44' in holes 150" even though the spindle teeth 74 and/or 75 are aligned with the spool teeth 171 and/or 172. When the spindles 62 and 63 are advanced by the take-up mechanism TM, these teeth will move out of alignment, and the springs 64 and/or 71 will move the spindles 62 and/or 69 into their operating positions shown in FIG. 9.

As is apparent from the drawings, the housing sections 151 and 152 are symmetrical. Thus, the cartridge 150 can be loaded into the printer 20 with either the housing section 152 in position against the frame member 44 as illustrated or with the housing section 151 against the frame plate 44. Assuming the ink ribbon IR in the cartridge 150 is twice as wide as needed, the ink ribbon IR can be advanced through the printer 20 so that ink 199 is used from the ink ribbon IR only to the left of the centerline CL' in FIG. 7. In so doing, the ink ribbon passes from the supply roll SR to the take-up roll TR. When the sensor 198 senses the area 201 of the ink ribbon IR, operation of the printer 20 is interrupted. The user thereupon removes the cartridge 150, flips the cartridge over, and reloads the cartridge 150 so that the housing section 151 is now against the frame plate 44. Ink is now used from the ink ribbon on the other side of the centerline CL'.

As best shown in FIG. 5, the portion of the ink ribbon IR which is outside the housing 150' travels along a printer path which is angled. More particularly, the ink ribbon IR passes upwardly and to the left after passing around roll 162 to between the print head 127 and the platen roll 56. From there the ink ribbon IR passes partly about a guide or guide roll 202 cantilevered to the frame plate 44. From there the ink ribbon IR passes upwardly and to the right until it passes partly about the roll 163.

Before a cartridge 150 is inserted into the printer 20, the ink ribbon path is as shown by phantom lines in FIG. 7. Insertion of the cartridge 150 is facilitated by use of an installation device generally indicated at 203. The device 203, which is preferably constructed or one-piece molded plastics material, includes an arm 204 having a pivot 205 received in the bore 185 in the roll 163. A stud 206 in the arm 204 is adapted to be inserted in a recess 207 (FIG. 4) in the housing section 151. The arm 204 mounts a guide 208 for the ink ribbon IR. The arm 204 also mounts a resilient, split, tubular stud 209 adapted to be received in the bore 184 of the roll 162. The installation device 203 is shipped with the cartridge 150 assembled in the orientation shown in FIG. 7.

With reference to FIG. 4, there is shown another retainer generally indicated at 210. The retainer 210 is of one-piece molded plastics construction and includes a plate portion 211, a blade or locking portion 212 and a resilient, split, tubular brake-member 213. The plate portion 211 includes a finger-engageable hole 211'. When the cartridge 150 is shipped to the user, the retainer 210 is in place on the cartridge 150 with the blade portion inserted into the roll 166 between teeth 171 so the roll 166 is locked in position and cannot rotate. The tubular portion 213 is inserted into the roll 165 so that the outside of the tubular portion frictionally contacts the teeth 172. Thus, the brake member 213 applies a light braking force to the roll 165. When the user is ready to load the cartridge 150 into the printer 20, the user moves the arm 204 from the stored portion shown in FIG. 7 to the extended position shown in FIG. 8. In this position, the exposed ink ribbon IR is under tension. The blade 212 of the retainer 210 prevents the roll 166 from rotating. However, the frictional slip-fit between the roll 165 and the tubular brake member 213 enables the roll 165 to rotate as the arm 204 is moved to the FIG. 8 position to enable ink ribbon IR to be paid out of the supply on the spool 165. In the FIG. 8 position, the stud 206 has been inserted into the recess 207. This is accomplished by flexing the portion 204' of the arm 204. As shown in FIG. 8, the exposed portion of the ink ribbon IR, that is, the portion of the ink ribbon IR which is outside the cartridge housing 150', takes a non-linear path corresponding generally to the printer path which the ink ribbon IR takes when the cartridge 150 is loaded in the printer 20.

When the cartridge 150, the installation device 203 and the retainer 210 are in the position shown in FIG. 8, the cartridge 150 can be easily loaded into the printer 20. As the pins 182 and 183 enter the respective rolls 162 and 163 and as the spindles 69 and 62 enter respective rolls 165 and 166, the exposed portion of the ink ribbon IR enters a gap between the print head 127 and the platen roll 56 and passes partly about the guide 202. Continued movement of the cartridge 150 toward the frame plate 44 results in the spindles 62 and 69 pushing against the blade 212 and the brake member 213 to push the retainer 210 away from the cartridge 150. Also, the pins 182 and 183 push the stud 209 and the pivot 205 out of the respective bores 184 and 185 to strip the installation device 203 from the cartridge 150.

When the cartridge 150 is positioned against the frame plate 44, the cartridge 150 is ready to be locked or latched in place. A lock or latch generally indicated at 214 includes a shaft 215 rotatably mounted in holes 217 (only one of which is shown) in leg portions 91 and 92 of the bracket 90. A lock member 218 is non-rotatably secured to the shaft 215. Toothed pulleys 146*a* and 215*a* are secured to respective shafts 146 and 215. A toothed belt 147*a* meshes with the pulleys 146*a* and 215*a*. Clockwise movement of the handle 147 moves the cam 145 to the solid line position in FIG. 5 and simultaneously moves the lock 218 to the position also shown in FIG.

5. Conversely, counterclockwise movement of the handle 147 moves the cam 145 to the phantom line position PL and moves the lock 218 clear of the cartridge 150 to enable its removal. When the lock member 218 is in the gap between the projections 220 and 221 (FIG. 4) on the cartridge 150, removal of the cartridge is prevented. Therefore, the cartridge 150 is locked in position by the lock 214.

With reference to FIG. 3, there is shown the reel assembly 26. The assembly 26 is shown to include a tubular hub 223 having a shank 224 received in a recess 225. The shank 224 is solid and closes off one end of the hub 223. A screw 226 extends through a hole in the shank 224 and secures the hub 223 to the frame plate 44. The outer surface of the hub 223 has axially spaced annular ridges 226 defining intervening grooves 227. The hub 223 has a pair of diametrically located external axially extending grooves 228.

Figure 13:
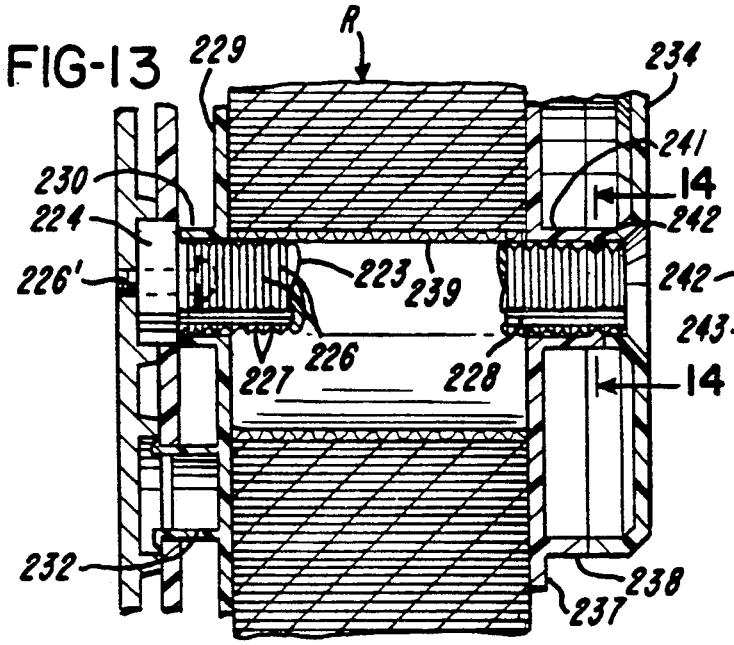
FIG. 13 is a fragmentary sectional view taken generally along line 13—13 of FIG. 12.
Figure 14:
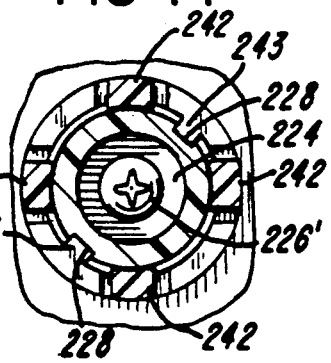
FIG. 14 is a sectional view taken generally along line

With reference to FIGS. 3 and 13, a side plate 229 has a tubular member or flange 230 for receiving the hub 223. The flange 230 abuts the shank 224. The side plate 229 has a pair of slots 231. The side plate 229 has a projection 232 received in a recess 233 in the frame plate 44. A hub member 234 has a pair of resilient snaps 235 releasably snapped into the slots 231. The hub member 234 has a central hole 236 for receiving the hub 223. A side plate 237 has an integrally molded hub member 238. With reference to FIG. 3, a roll R of record medium RM is shown to have a core 239 which is adapted to be supported on the hub members 234 and 238. The hub members 234 and 238 are shown to be opposed and to extend inwardly toward each other. The core 239 has an inside diameter at least slightly larger than the outside diameter of the hub members 234 and 238. The hub members 234 and 238 and the side plate 237 are oriented as shown in FIG. 3 in the event of a large diameter roll R is used.

In the event a small diameter roll is used, the side plate 237 and its hub member 238 and the hub members 234 can be oriented as shown in FIG. 13. In this orientation, the core 29 is supported directly on the hub 223. The side plate 237 is oriented oppositely from the position shown in FIG. 3. The hub member 238 (FIG. 13) extends outwardly, that is, away from the end plate 229. The hub member 234 is stored on the hub member 238 as shown in FIGS. 1, 13 and 15. Each snap member 235 is snapped into a respective groove 240 in the hub member 238. Thus, the roll R is positioned between and in contact with the end plates 229 and 237. The end plate 237 has an integrally formed spring finger or detent 242 engageable in a groove 227. The tubular member 241 also has a pair of integral keys 243 received in grooves 228 which prevent rotation of the end plate 237.

With reference to FIG. 4, there is shown a bracket 244 having a base portion 245 secured to the base plate 42 and a vertical portion 246. The vertical portion 246 rotatably mounts rolls 247 and 248. The roll 247 is disposed above the upper surface of the base portion 245. The roll 248 is disposed generally between the roll 247 and the hub 223. The record medium RM is shown by both a solid line and a phantom line in FIG. 5. The second medium RM in the solid line is shown to be in contact only with the roll 247. The roll R is wound with the face F to be printed upon, face-side-in on the roll R. With the alternative arrangement represented by phantom line for the record medium RM, the face F' to he printed upon is face-side-out on the roll R. When the record medium is wound face-side-out, the roll R is positioned so that the record medium RM is guided partly about roll 248 and, at a downstream location, partly about the roll 247. From there the record medium RM passes between a skewed roll 249 which drives the edge of the web of record medium against the vertical portion 246 From there the record medium RM passes about a curved guide 250 from which the record medium RM passes upwardly and to the left as viewed in FIG. 5 to between the print head 127 and the platen roll 56. The platen roll 56 advances the web of record medium RM while the print head 127 is printing on the record medium RM. The printed record medium RM is advanced to the left (FIG. 5) to a cutting mechanism generally indicated at 251 by which the web of record medium RM is cut into separate tickets or tags T. The cutting mechanism 251 includes an elongated knife 252 and a rotary knife 253 cooperable with the knife 252. The rotary knife is driven by an electric motor 254 (FIG. 4). The cutting mechanism 251 is generally in accordance with the cutting mechanism disclosed in copending U.S. patent application Ser. No. 690,064, filed Jan. 9, 1985, now U.S. Pat. No. 4,407,692. The entire cutting mechanism travels with the advancing web of record medium RM against the action of a return spring 255. For this purpose, the cutting mechanism 251 pivots on a shaft 256 received in pockets 257 in a bracket 258.

During operation of the printer 20, the electric motor 49 is driven which causes the platen roll 56 to advance both the record medium RM and the ink ribbon IR. The spindle 69 applies a slight braking force to the roll 165 due to the action of the brake 88. The spindle 62 is driven at a rate of speed such that the clutch 59 slips a little even when the roll 166 is essentially empty (e.g. when the cartridge 150 is new). As the take-up roll 166 continues to load slippage of the clutch 59 increases.

Other embodiments and modifications of the invention will suggest themselves to those skilled in the art, and all such of these as come within the spirit of this invention are included within its scope as best defined by the appended claims.

We claim:

1. A method for loading an ink ribbon comprising applying a shaft cover to the front end of a ribbon guide shaft projecting in a cantilevered state from a side face of a case of a printer body; fitting cores of the ink ribbon respectively on the front ends of a ribbon feed shaft and a ribbon take-up shaft both projecting in a cantilevered state from said side face of said printer body case; the ink ribbon passing round the outer periphery of said shaft cover; and pushing in said cores and said shaft cover simultaneously to set the ink ribbon in a predetermined certain position.

2. An ink ribbon loading method according to claim 1, wherein said shaft cover is positioned outside said case during the operation for loading the ink ribbon.

3. An ink ribbon loading method according to claim 1, wherein said ribbon feed shaft is positioned inside said case.

4. An ink ribbon loading method according to claim 1, wherein said ribbon take-up shaft is positioned inside said case.

5. An ink ribbon loading method according to claim 1, wherein the width of the ink ribbon is almost equal to that of paper to be printed.

6. An apparatus for loading an ink ribbon, comprising a ribbon guide shaft; a ribbon feed shaft fitted in a core of the ink ribbon; a ribbon take-up shaft fitted in a core of the ink ribbon; a platen; a printing head; and a shaft cover constituted by a cylindrical member fitted slidably on said ribbon guide shaft; said ribbon guide shaft, said ribbon shaft, said ribbon take-up shaft, said platen and said printing head being projected in a cantilevered state from a side face of a case of a printer body.

7. An ink ribbon loading apparatus according to claim 6, wherein said printing head is a line thermal head.

8. An ink ribbon loading apparatus according to claim 6, wherein said ribbon feed shaft is positioned inside said case.

9. An ink ribbon loading apparatus according to claim 6, wherein ribbon take-up shaft is positioned inside said case.

10. An ink ribbon loading apparatus according to claim 6, wherein the width of the ink ribbon is almost equal to that of the paper to be printed.

11. An apparatus for loading an ink ribbon, comprising a plurality of ribbon guide shafts; a ribbon feed shaft fitted in a core of the ink ribbon; a ribbon take-up shaft fitted in a core of the ink ribbon; a platen; a printing head; and a shaft cover constituted by a cylindrical member fitted slidably on each of said ribbon guide shafts; said ribbon guide shafts, said ribbon feed shaft, said ribbon take-up shaft, said platen and said printing head being projected in a cantilevered state from a side face of a case of a printer body.

12. An ink ribbon loading apparatus according to claim 11, wherein said shaft covers comprise a plurality of cylindrical members fitted slidably on said ribbon guide shafts and a connecting member for integrally connecting the outside ends of said cylindrical members.

13. Apparatus for loading an ink ribbon into a printer having a thermal print head, a pair of cantilevered locator pins, a first spindle for an ink ribbon supply spool, and a second spindle for a take-up spool, comprising: a thermal ink ribbon, a supply spool with the thermal ink ribbon wound thereon, a takeup spool for receiving the ink ribbon from the supply spool, a pair of tubular ink ribbon guides, means for enabling the ink ribbon, the supply spool, the take-up spool and the tubular ink ribbon guides to be moved in unison from a first loading position wherein the ink ribbon is laterally spaced outwardly form the print head to a second operating position wherein (a) the ink ribbon is in operative alignment with the print head for printing on record members, (b) the locator pins are received in the tubular guides and (c) the tubular guides are held in parallel relationship to cause the ink ribbon to track in alignment with the print head.

14. Apparatus as defined in claim 13, wherein the enabling means includes a pair of symmetrical end plates.

15. Apparatus for loading an ink ribbon into a printer having a thermal print head, a pair of cantilevered locator pins, a first spindle for an ink ribbon supply spool, and a second spindle for a take-up spool, comprising: a thermal ink ribbon, a supply spool with the thermal ink ribbon wound thereon, a takeup spool for receiving the ink ribbon from the supply spool, a pair of ink ribbon guides, means for enabling the ink ribbon, the supply spool, the take-up spool and the ink ribbon guides to be moved in unison from a first loading position wherein the ink ribbon is laterally spaced outwardly form the print head to a second operating position wherein the ink ribbon is in operative alignment with the print head for printing on record members and the guides are brought into and held in parallel relationship by the locator pins to cause the ink ribbon to track in alignment with the print head.

16. Apparatus as defined in claim 15, wherein the enabling means includes a pair of symmetrical end plates.

17. Method of loading an ink ribbon into a printer having a thermal print head, a pair of parallel cantilevered locator pins, a first spindle for an ink ribbon supply spool, and a second spindle for a take-up spool, comprising the steps of: providing a supply spool with a thermal ink ribbon wound thereon and a take-up spool for receiving the ink ribbon from the supply spool and a pair of ink ribbon guides, positioning the supply and take-up spools and the ribbon guides in general alignment with the first and second spindles and the locator pins, respectively, but spaced outwardly form the print head, and subsequently, simultaneously moving the supply and take-up spools and the guides in unison to a position in which the ink ribbon can track in alignment with the print head by using the locator pins to orient and held the guides in parallel relationship.

* * * * *

UNITED STATES PATENT AND TRADEMARK OFFICE

CERTIFICATE OF CORRECTION

PATENT NO. : 5,186,553

DATED : February 16, 1993

INVENTOR(S) : Ikuzo Sugiura, Mitsuo Uchimura & Kouichi Kowamura

It is certified that error appears in the above-identified patent and that said Letters Patent is hereby corrected as shown below:

On the title page, item [75] Inventors:
"Ronald L. Fogle, Lebanon; Orville C. Huggins, Dayton, both of Ohio." should be deleted.
On the title page, item [62]:
after "Division of Ser. No.", "223,207" should be --232,207--.
Column 1, line 6, "223,207" should be --232,207--.
Column 2, line 40, after "line", the phrase --14--14 of Fig 13;-- has been omitted.
Column 5, line 24, "31" should be --131--.
Column 7, line 34, "and-" should be --and--.
Column 9, line 62, "second" should be --record--.
Column 9, line 66, "he" should be --be--.
Column 10, line 6, after "246", the period --.-- has been omitted.
Column 11, line 13, after "wherein", --said-- has been omitted.
Column 11, line 45, "form" should be --from--.
Column 12, line 19, "form" should be --from--.
Column 12, line 40, "form" should be --from--.

UNITED STATES PATENT AND TRADEMARK OFFICE

CERTIFICATE OF CORRECTION

PATENT NO. : 5,186,553

DATED : February 16, 1993

INVENTOR(S) : Ikuzo Sugiura, Mitsuo Uchimura & Kouichi Kowamura

It is certified that error appears in the above-identified patent and that said Letters Patent is hereby corrected as shown below:

Column 12, line 44, "held" should be —hold—.

Signed and Sealed this

Twenty-third Day of November, 1993

*Attest:*

Bruce Lehman

BRUCE LEHMAN

*Attesting Officer*

*Commissioner of Patents and Trademarks*